United States Patent [19]

Rogers et al.

[11] Patent Number: 4,759,772

[45] Date of Patent: Jul. 26, 1988

[54] METHOD OF CONTROLLING SELF-IGNITION OF LOW RANK COAL

[75] Inventors: Edward S. Rogers, Princeton; Arno H. Reidies, LaSalle; Mark A. Herbstrith, Peru, all of Ill.

[73] Assignee: Carus Corporation, LaSalle, Ill.

[21] Appl. No.: 76,390

[22] Filed: Jul. 22, 1987

[51] Int. Cl.[4] ..... C10L 5/24

[52] U.S. Cl. ..... 44/501; 44/592

[58] Field of Search ..... 44/1 R, 4, 6, 26, 1 G

[56] References Cited

U.S. PATENT DOCUMENTS

| | | | |
|---|---|---|---|
| 1,112,547 | 10/1914 | Morin et al. | 44/4 |
| 1,799,631 | 4/1931 | Mennie | 44/4 |
| 4,400,176 | 8/1983 | Kutta | 44/6 |

FOREIGN PATENT DOCUMENTS

| | | | |
|---|---|---|---|
| 1202485 | 4/1986 | Canada | 44/1 R |
| 568447 | 12/1923 | France | 44/1 R |

*Primary Examiner*—Carl F. Dees

*Attorney, Agent, or Firm*—Tilton, Fallon, Lungmus & Chestnut

[57] ABSTRACT

Self-ignition of low rank coal is inhibited by application of a permanganate salt, such as potassium permanganate, together with a phosphorus compound, such as a phosphoric or polyphosphoric acid. The inhibitors are applied in aqueous solution following drying of the particulate coal. The combination treatment is much more effective than the use of a permanganate salt alone.

10 Claims, No Drawings

METHOD OF CONTROLLING SELF-IGNITION OF LOW RANK COAL

FIELD OF INVENTION

The field of the invention is treatment of sub-bituminous and lignitic coals to reduce the tendency of the coal, after pulverizing and drying, to spontaneously ignite.

BACKGROUND OF INVENTION

Self-heating of coal, which can cause self-ignition, is a long-standing problem in the mining, processing, handling, storage, and transportation of this fossil fuel. In spite of many decades of extensive study and research in various parts of the world, no fully satisfactory solution to this problem has been devised to date. The main chemical process involved in the self-heating of coal is the exothermic interaction of atmospheric oxygen with the carbonaceous matter, even though other heat generating processes (such as adsorption or condensation of water onto the coal) can sometimes serve as contributing factors. This atmospheric oxidation of coal will or can start at room temperature. In most cases, this oxidation process represents no hazard because the heat generated is readily dissipated. Only in instances where prevailing conditions favor the accumulation of heat will the coal gradually heat up to higher temperatures (thereby accelerating the rate of oxidation) and eventually ignite spontaneously.

The susceptibility to self-heating is especially pronounced in low rank coals, represented by sub-bituminous coal and lignites. In recent years, certain low rank coals have become commercially important because of their low sulfur content which is usually under 0.5%. Low sulfur coal are an attractive choice for electric power generation in such regions where acid rain problems prevail. In the State of Wisconsin, for example, legislation has been passed that requires sulfur dioxide emissions to be cut in half by the year of 1993. Western low rank coal, particularly from Wyoming, looks promising for reaching this goal. However, this Wyoming coal as mined contains up to 30% moisture and for economic reasons requires drying before shipment. Drying can raise its Btu value, for example, from about 8,000 per pound to 12,500 per pound.

The drying process, usually to less than 10% water, leaves the coal in a virtually pyrophoric state. The coal as it comes out of the dryer readily interacts with atmospheric oxygen up to the point of self-ignition. The commercial use of low sulfur Western coal therefore depends to a large degree on the availability of a dependable and economical method to inhibit self-ignition. Although numerous techniques have been developed and proposed, none of them appears to be satisfactory. Thus, at this time, low rank Western coal is not offered commercially in dried form.

One approach to controlling the self-ignition of low rank coals has been to subject the outer surfaces of the coal particles to a pre-oxidation, using air or oxygen. For example, U.S. Pat. No. 3,723,079 describes a sequential process in which the coal is first over-dried, then treated with oxygen at a temperature of 175° to 225° C., and thereafter partially rehydrated. U.S. Pat. Nos. 4,396,395 and 4,402,706 of 1983 describe apparatus and methods for oxidizing dried low rank coal. In addition to air oxidation, these patents disclose the application of crude oil to further control self-ignition.

The use of pre-oxidation of coal with air is not known to have become a commercial process for treating low rank coal. The addition of crude oil may have been used to some extent in processing of low rank coal. However, prior to the present invention the problem of controlling the self-ignition of low rank coal, such as Wyoming coal, has not received an adequate solution. Low rank coal has therefore continued to be shipped and stored at a much higher moisture content than would be desirable for the most efficient handling, shipping, and burning.

It has been suggested that potassium permanganate ($KMnO_4$) might be used to pre-oxidize low rank coal. However, no tests are known to have been reported with respect to coal treatment with permanganate for this purpose. It is recognized that when permanganate acts on organic matter, manganese dioxide ($MnO_2$) is formed. Consequently, it would be assumed that treatment of low rank coal with $KMnO_4$ would leave residual manganese dioxide on the coal surfaces, and $MnO_2$ is recognized as a catalyst for oxidation reactions. This consideration may have discouraged experiments with permanganate for pre-oxidation.

SUMMARY OF INVENTION

During the experimental work leading to the present invention, it was found that application of a solution of potassium permanganate can partially control self-ignition, but that this treatment alone was not sufficient to stabilize dried low rank coal for safe shipment and storage. The self-ignition problem was not satisfactorily solved until the further discovery that phosphorous compounds applied in combination with the permanganate are much more effective than permanganate alone, markedly reducing the tendency of dried low rank coal to spontaneously ignite. When water-soluble permanganates and phosphate are used together they appear to act synergistically. But scientific explanation for the improved results has not been elucidated.

An important feature of the present invention is that the permanganate and phosphate treating agents can be applied to the coal in concentrated aqueous solutions of low volume. The solutions containing the treating agents need only spread over the outer surfaces of the coal particles to form thin films or coatings thereon. This permits the coal to be dried to a desired final moisture content, and then treated by the method of this invention without appreciably increasing the moisture content of the coal. The treating agents are standard relatively inexpensive chemicals, and only small quantities are needed to accomplish effective stabilization. Further, the treating agents are compatible and can be applied in a single solution mixture.

DETAILED DISCLOSURE

The method of this invention has particular applicability to low rank coals which are subject to self-ignition after drying to a low moisture content. The term "low rank coal" includes sub-bituminous, lignitic and so-called "brown" coals. Presently in the United States from a commercial standpoint, the treatment of Wyoming Powder River Basin sub-bituminous coal is particularly important. Low rank coals as mined contain large amounts of water, such as 20 to 40% or more water by weight. It is desired to dry such coals to reduce weight before shipment and handling. Drying to 10% water or less is desired. For example, the method of this invention is preferably applied to low rank coals dried to 1 to 8% water.

The treating agents which are used in combination for the purpose of this invention comprise water-soluble permanganate salts and phosphorous compounds. Sodium or potassium permanganates ($KMnO_4$ or $NaMnO_4$) are preferred as the permanganate treating agent. However, other water-soluble permanganates can be used, including other alkali metal as well as water-soluble alkaline earth metal permangantes. Potassium permanganate is the least expensive reagent but sodium permanganate is also of low cost, and has the advantage of being more soluble in water than potassium permanganate, thereby permitting it to be applied at a higher concentration.

The phosphorus compound can be an acid or a salt, such as phosphoric acid or polyphosphoric acid, or a mixture of such acids, or, alternatively or additionally, the water-soluble salts of such acids. Orthophosphoric acid ($H_3PO_4$) and its salts are preferred but higher phosphoric acids and their salts can also be used, including pyrophosphoric acids, tripolyphosphate, and tetrapolyphosphate. Sodium or potassium salts are preferred, but other water-soluble salts can be used, such as other water-soluble alkali metal or alkaline earth metal salts. Salts should not be employed which form unstable permanganates such as ammonium permanganate. From the standpoint of cost and availability, sodium orthophosphate is preferred, and may be used in its mono-, di-, or tri-basic forms (i.e., $NaH_2PO_4$, $Na_2HPO_4$, and $Na_3PO_4$).

The amounts of the additives to be used can be based on $KMnO_4$ for the permanganate, and $P_2O_5$ for the phosphorus compounds. From 0.1 to 5 pounds (lbs) of $KMnO_4$ or molar equivalent amount of other permanganate salt can be used. The presently preferred amount of the permanganate salt based on $KMnO_4$ is from about 0.5 to 2 pounds per ton of coal. (In this specification, the term "ton" refers to the U.S. standard ton which equals 2,000 lbs.).

The phosphorus compound, selected from phosphoric and polyphosphoric acids and their water-soluble salts, is applied in an amount of from 0.2 to 10 pounds per ton of coal, based on phosphorus content expressed as $P_2O_5$. A presently preferred amount of the phosphorus additive is from about 0.5 to 3 lbs ($P_2O_5$ basis) per ton of coal.

While the ratio of the $P_2O_5$ to the permanganate salt does not appear to be highly critical, certain ratios are advantageous. In general, it is preferred to employ molar ratios within the range from 0.5 to 4 to 1 ($P_2O_5$:$KMnO_4$). The preferred ratios appear to be from about 0.8 to 2:1 ($P_2O_5$:$KMnO_4$).

No special procedure or equipment is required for applying the treating agents of this invention. Concentrated aqueous solutions can be used, and spray application is efficient. Solutions of the treating agents can be sprayed onto the particulate coal after drying. The application of the treating agents is preferably carried out while the coal is being agitated, such as in a screw conveyor, rotating drum, etc. Distribution of the treating solution over the outer surface of all the coal particles is desirable. Heating is not usually required. The application can be carried out at ambient temperature for both the coal and the applied solution. However, if the coal is still warm from the drying application, this is not objectionable. In some cases it may be desirable to apply the solution at an elevated temperature to increase the solubility of the additives being used, such as with potassium permanganate which has a relatively low solubility in water at ordinary room temperatures.

In a preferred procedure, a single concentrated aqueous solution is prepared containing both the permanganate salt and the phosphorous compound. Enough water should be used to dissolve all of the treating agents and the amount of water should be sufficient so that when the salt is sprayed onto the coal substantially all of the coal's outer surfaces are covered with a thin film. The addition of more water than needed for these purposes is undesirable unless the coal has been overdried. The added water increases the moisture content of the coal. In general, it is not necessary to increase the moisture content more than about 1 to 1.5% by the addition of the treating agents. In preferred embodiments, the moisture content of the coal is not appreciably increased, being kept below about 12% by weight after the treating solution has been added.

The method of this invention and the results obtainable thereby are further illustrated by the following experimental examples.

EXAMPLE I

Comparative tests were carried out using 10 lb. quantities of predried coal (approximate moisture content 11%) from the Powder River Basin, Wyo. The 10 lb quantities were separately placed in a slow speed paddle-type mixer, and sprayed with the treating solution while mixing. In each case, approximately 50 ml of the treating solution was applied. In one comparison, No. 5 fuel oil was used instead of an aqueous solution of the treating agents. The treated coal was screened, and a minus 6 mesh fraction was submitted to a stability testing.

Stability Test Procedure

Five hundred grams (500 g) coal with a particle size range from minus 6 to plus 60 mesh (USS screen) is placed in an electrically heated, well insulated stainless steel reactor of 4 inch diameter. The reactor is fitted at the bottom with a gas inlet tube and also with a temperature sensing device (thermocouple). While heating the coal to 70° C., nitrogen gas is passed through the coal, which at time zero is replaced by a 2 liter per minutes (1/min) flow of oxygen presaturated with $H_2O$ at 70° C. Moist oxygen flow continues until a sharp increase in temperature occurs, which indicates the onset of spontaneous combustion. The elapsed time between the start of the test (time zero) and the temperature rise observed is expressed in minutes and constitutes a measure for the stability (i.e., the resistance of the coal to self-ignition). As soon as the coal temperature exceeds 150° C., the oxygen flow is shut off and the system is purged with $CO_2$ gas to quench the ignition process.

Results

The coal treatments and stability test results are summarized in Table A. Series A respresents the principal comparative test. Series B was a short repeat in which the untreated coal was compared with $KMnO_4$ alone at 1.0 and 1.5 lbs/ton application rates.

TABLE A

| Coal Treatment | Stability Series A (minutes) | Stability Series B (minutes) |
|---|---|---|
| (1) Untreated | 120 | 100 |

TABLE A-continued

| Coal Treatment | Stability Series A (minutes) | Stability Series B (minutes) |
|---|---|---|
| (2) #5 Fuel oil (2 gal/ton) | 120 | |
| (3) $KMnO_4$ (1.0 lb/ton) | — | 100 |
| (4) $KMnO_4$ (1.5 lb/ton) | 350 | 280 |
| (5) $KMnO_4$ (1.0 lb/ton) + $H_3PO_4$ (2.0 lb/ton) | >780 | |
| (6) $KMnO_4$ (1.0 lb/ton) + $Na_2HPO_4$ (2.0 lb/ton) | >660 | |
| (7) $KMnO_4$ (1.0 lb/ton) + $Na_3PO_4$ (2.0 lb/ton) | >720 | |
| (8) $H_3PO_4$ (3.0 lb/ton) | 300 | |

EXAMPLE II

The following Table B sets out additional data for use in practicing the method of this invention. These phosphoric acid derivatives can be used with the permanganate salts as previously described.

TABLE B

| Name of Phosphoric Acid Derivative | Formula | % $P_2O_5$ | Indicated Dosage in lb. per ton of coal | Solubility at 25° C. |
|---|---|---|---|---|
| Disodium hydrogen monophosphate | $Na_2HPO_4$ | 50 | 1 to 6 | 12 g/100 g $H_2O$ |
| Trisodium monophosphate | $Na_3PO_4$ | 43.3 | 1.15 to 6.9 | 14.5 g/100 g $H_2O$ |
| Sodium dihydrogen monophosphate | $NaH_2PO_4$ | 59.2 | 0.8 to 5 | 95 g/100 g $H_2O$ |
| Disodium dihydrogen diphosphate (pyro) | $Na_2H_2P_2O_7$ | 63.9 | 0.8 to 4.7 | 12 g/100 g $H_2O$ |
| Tetrasodium diphosphate (pyro) | $Na_4P_2O_7$ | 53.4 | 0.9 to 5.6 | 6 g/100 g $H_2O$ |
| Pentasodium triphosphate (poly) | $Na_5P_3O_{10}$ | 57.9 | 0.9 to 5.2 | 14.7 g/100 g $H_2O$ |
| Glassy phosphate, also known as hexametaphosphate (Calgon) | $(NaPO_3)_n$ n = 6–12 | ~68% | 0.75 to 4.4 | quite soluble |
| Tetrapotassium diphosphate (pyro) | $K_4P_2O_4$ | 50.3 | 1 to 6 | 187 g/100 g $H_2O$ |
| Dipotassium hydrogen monophosphate | $K_2HPO_4$ | 40.8 | 1.2 to 7.4 | 159 g/100 g $H_2O$ |

We claim:

1. The method of controlling self-ignition of low rank coal in dried particulate form, comprising applying to said coal in aqueous solution (i) a water-soluble permanganate salt and (ii) a phosphorus compound selected from the group consisting of phosphoric and polyphosphoric acids and their water-soluble salts, from 0.1 to 5 pounds (lbs) of the permanganate salt (based on $KMnO_4$) and from 0.2 to 10 lbs of the phosphorous compound (based on $P_2O_5$) being applied per ton of coal, the molar ratio of the permanganate salt to the phosphorous compound being approximately equivalent to a $P_2O_5$ to $KMnO_4$ molar ratio of 0.5-4:1.

2. The method of claim 1 in which said permanganate salt is selected from the group consisting of $KMnO_4$ and $NaMnO_4$.

3. The method of claim 1 in which said phosphorous compound is selected from the group consisting of orthophosphoric acid, and the sodium and potassium salts thereof in mono-, di-, and tri-basic forms.

4. The method of claims 1, 2, or 3 in which said permanganate salt and said phosphorous compound are applied in the same aqueous solution, and the amount of water thereby applied to the coal being less than 1.5% the weight of the dried coal.

5. The method of claims 1, 2, or 3 in which said permanganate salt is applied in an amount of from 0.5 to 2.0 lbs ($KMnO_4$ basis) per ton of coal.

6. The method of claims 1, 2, or 3 in which said phosphorus compound is applied in an amount of 0.5 to 3 lbs ($P_2O_5$ basis) per ton of coal.

7. The method of controlling self-ignition of low rank coal in dried particulate form, comprising applying to said coal in aqueous solution (i) a permanganate salt selected from the group consisting of $KMnO_4$ and $NaMnO_4$ and (ii) a phosphorous compound selected from the group consisting of the sodium and potassium salts of orthophosphoric acid in their mono-, di-, and tri-basic forms, from 0.5 to 2.0 pounds (lbs) based on $KMnO_4$ of the permanganate salt and from 0.5 to 3 lbs based on $P_2O_5$ of the phosphorous compound be applied per ton of coal.

8. The method of claim 7 in which the molar ratio of the permanganate salt to the phosphorous compound is equivalent to a $P_2O_5$ to $KMnO_4$ molar ratio of 0.8–2:1.

9. The method of claims 7 or 8 in which said permanganate salt and said phosphorous compound are applied in the same aqueous solution, and the amount of water thereby applied to the coal being less than 1.5% of the dried weight of the coal.

10. The method of claims 7 or 8 in which said permanganate salt is $KMnO_4$ and said phosphorous compound is selected from the group consisting of $Na_3PO_4$, $Na_2HPO_4$, and $NaH_2PO_4$.

* * * * *